US007520503B2

(12) United States Patent
Sussmeier et al.

(10) Patent No.: US 7,520,503 B2
(45) Date of Patent: Apr. 21, 2009

(54) SHEET MATERIAL INVERTER

(75) Inventors: John W. Sussmeier, Cold Spring, NY (US); John R. Masotta, Bethel, CT (US); Boris Rozenfeld, New Milford, CT (US); William J. Wright, Killingworth, CT (US); Daniel J. Williams, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 161 days.

(21) Appl. No.: 11/508,429

(22) Filed: Aug. 23, 2006

(65) Prior Publication Data

US 2008/0048385 A1 Feb. 28, 2008

(51) Int. Cl.
*B65H 29/00* (2006.01)

(52) U.S. Cl. ..... 271/186; 271/65

(58) Field of Classification Search ..... 271/227, 271/186, 65; 198/404, 403; 194/206, 207; 209/534

See application file for complete search history.

(56) References Cited

U.S. PATENT DOCUMENTS

| | | | | | |
|---|---|---|---|---|---|
| 3,744,614 | A * | 7/1973 | Shooter et al. | ..... | 198/404 |
| 3,877,569 | A * | 4/1975 | Shields | ..... | 198/377.03 |
| 4,124,128 | A * | 11/1978 | Adams et al. | ..... | 414/788.3 |
| 4,699,564 | A * | 10/1987 | Cetrangolo | ..... | 414/765 |
| 5,201,399 | A | 4/1993 | Dietrich | | |
| 5,709,484 | A * | 1/1998 | Dorner | ..... | 400/188 |
| 5,771,058 | A * | 6/1998 | Kobayashi | ..... | 347/218 |
| 5,927,713 | A * | 7/1999 | Driscoll et al. | ..... | 271/298 |
| 6,279,901 | B1 * | 8/2001 | Fulmer | ..... | 271/272 |
| 6,286,828 | B1 * | 9/2001 | Adema | ..... | 271/186 |
| 6,779,791 | B2 * | 8/2004 | Kawamura et al. | ..... | 271/228 |
| 6,786,482 | B2 * | 9/2004 | Spatz | ..... | 271/185 |
| 6,942,213 | B2 * | 9/2005 | Endo et al. | ..... | 271/186 |
| 2005/0067762 | A1 * | 3/2005 | Bennett et al. | ..... | 271/184 |

FOREIGN PATENT DOCUMENTS

| | | | |
|---|---|---|---|
| EP | 1122198 | A2 * | 8/2001 |
| EP | 1122198 | B1 | 8/2001 |
| JP | 60218252 | A * | 10/1985 |
| JP | 01251799 | A | 10/1989 |
| JP | 06061275 | A | 3/1994 |
| JP | 10109793 | A | 4/1998 |

* cited by examiner

*Primary Examiner*—Patrick H MacKey
*Assistant Examiner*—Patrick Cicchino
(74) *Attorney, Agent, or Firm*—Brian A. Collins; Angelo N. Chacclas

(57) ABSTRACT

An apparatus for inverting the spatial orientation of sheet material from a desired input to a desired output orientation. The apparatus includes a cage assembly, a torque drive mechanism operative to rotate the cage assembly about a rotational axis and a sheet conveyance mechanism mounting to the cage assembly for conveying sheet material along the rotational axis of the cage assembly. The torque drive mechanism is adapted to assume input and output positions about the rotational axis wherein each position corresponds to the desired input and output orientations of the sheet material. The sheet conveyance mechanism is, further, adapted to: (i) receive sheet material when the cage assembly is in the input position, (ii) eject sheet material when the cage assembly is in the output position and (iii) retard the movement of the sheet material in response to rotation of the cage assembly by the torque drive mechanism.

17 Claims, 7 Drawing Sheets

SHEET MATERIAL INVERTER

TECHNICAL FIELD

This invention relates to apparatus for inverting the orientation of sheet material and, more particularly, to a new and useful apparatus and system for inverting sheet material or a stack/collation thereof for use in sheet material handling equipment such as mailpiece fabrication systems.

BACKGROUND ART

Sheet material handling systems frequently require sheet material or assembled collations thereof to be turned over to match a specific downstream requirement. For example, mailpiece fabrication equipment typically requires that sheet material be oriented face-up or face down depending upon the orientation of a receiving envelope This requirement has come under increasing demand as new and old equipment have, over the course of time, been merged. That is, some mailpiece fabrication systems require a face-up orientation while others employ a face-down presentation. Effective utilization and coordination of all systems/machines becomes inefficient when specific mailpiece fabrication jobs can only be processed on specific machines.

Various inversion modules have been developed to reorient sheet material for use in sheet handling equipment. One such apparatus is a twist module wherein sheets of material are directed linearly along a spiral path typically effected by a series of twisted belts or chords. While such twist modules retain the respective leading and trailing edge position of the sheet material, such modules require a lengthy axial path to change the face-up/face-down orientation of the sheet material. Furthermore, twist modules are less reliable when handling stacked collations inasmuch as the stacked sheets tend to skew as they follow the spiral path. Moreover, such twist modules are not reconfigurable to handle straight runs wherein sheet material inversion is not required. Consequently, another module must be introduced in place of the twist module to reconfigure the sheet material handling equipment.

A need, therefore, exists for a sheet inversion apparatus which is space efficient, reliable (especially when handling stacked collations) and is reconfigurable to facilitate multiple sheet feeding requirements.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

The invention will be fully understood when reference is made to the following detailed description taken in conjunction with the accompanying drawings.

SUMMARY OF THE INVENTION

An apparatus is provided for inverting the spatial orientation of sheet material from a desired input to a desired output orientation. The apparatus includes a cage assembly, a torque drive mechanism operative to rotate the cage assembly about a rotational axis and a sheet conveyance mechanism mounting to the cage assembly for conveying sheet material along the rotational axis of the cage assembly. The torque drive mechanism is adapted to assume input and output positions about the rotational axis wherein each position corresponds to the desired input and output orientations of the sheet material. The sheet conveyance mechanism is, furthermore, adapted to: (i) receive sheet material when the cage assembly is in an input position, (ii) eject sheet material when the cage assembly is in an output position and (iii) retard the movement of the sheet material in response to rotation of the cage assembly by the torque drive mechanism.

DETAILED DESCRIPTION

An apparatus for handling sheet material is described in the context of a mailpiece fabrication system wherein sheet material is handled and inserted into an envelope or pocket for mailing. It should be appreciated, however, that the apparatus disclosed herein may be employed in any material handling system wherein the orientation of the sheet material or stacked collations thereof is necessary for use in various subsystems/steps of the fabrication process. The embodiments disclosed herein, therefore, are merely illustrative of the inventive teachings and should not be construed as limiting the invention as described in the specification and appended claims.

Figure 1:
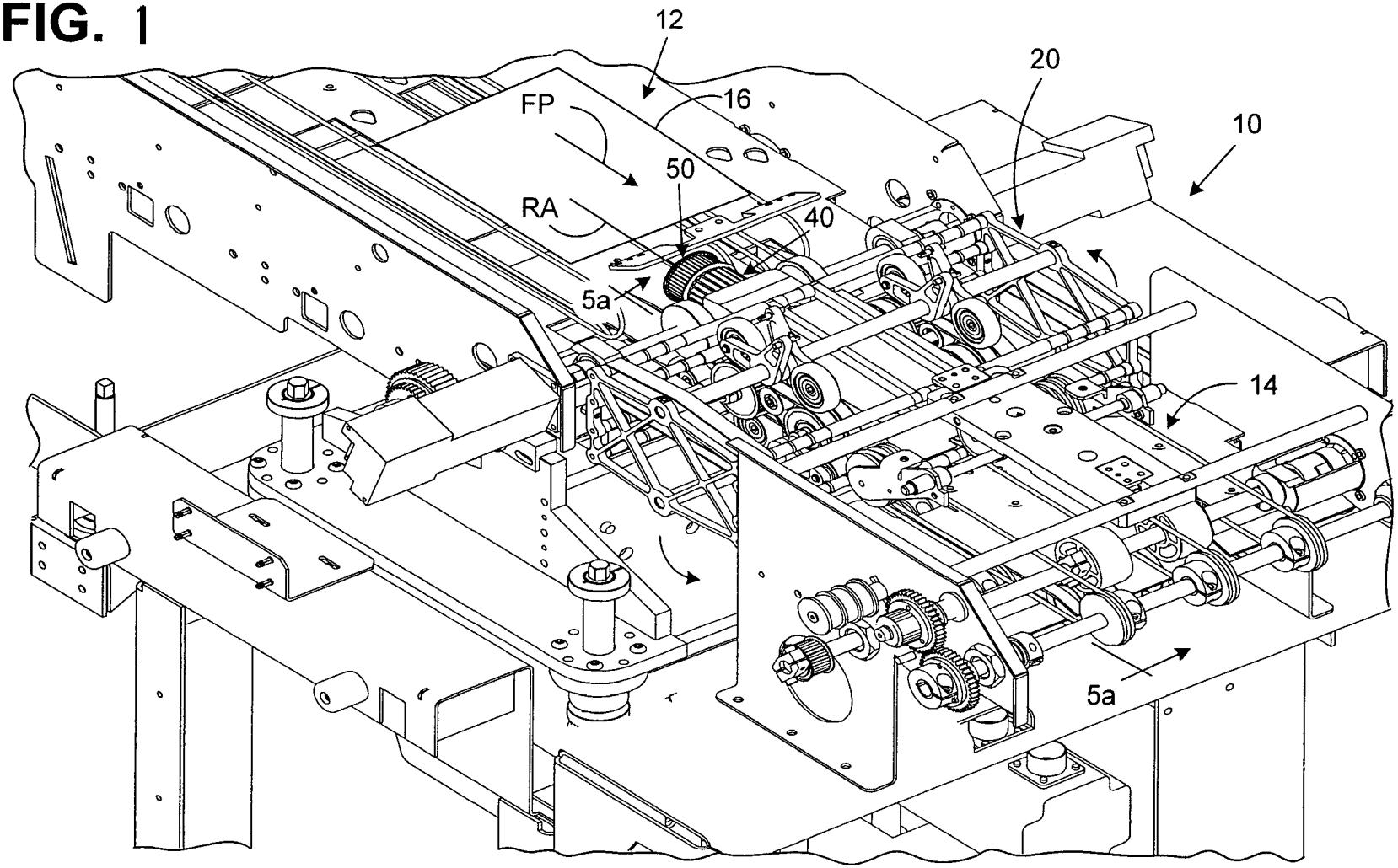
FIG. 1 is a partially broken away perspective view of a mailpiece fabrication device or mailpiece inserter including a sheet material inverter in accordance with the teachings of the present invention.

In FIG. 1, a perspective view is provided of an inventive sheet inversion apparatus 10 shown in combination with upstream and downstream sheet handling modules 12 and 14, respectively. In the mailpiece fabrication system illustrated, the upstream and downstream modules are referred to as "Gates" on a typical multi-station buffer with sheet material 16 traveling from left to right (in the direction of arrow FP indicative of the material feed path). In the context used herein, "sheet material" means individual sheets or a multi-sheet stack of material and, additionally, may include sheets fabricated from any of a variety of material compositions including paper, cardboard, fiber-reinforced composites, thermoplastics, open/closed reticulated foam, etc. Consequently, the terms "sheet material" and "stacked collations" may be used interchangeably herein.

The sheet material 16 exits the upstream gate or module 12 and enters the sheet inverter 10 according to the present invention. While the sheet material 16 will, in the most common or conventional handling operation be "inverted" to "flip" the face sheets from face-up to face-down and visa-versa, it should be appreciated that the sheet material inverter 10 of the present invention may perform multiple operations. For example, the inverter 10 may convey the sheet material 16 to the downstream gate or module 14 without altering its orientation or may change the orientation of the sheet material 16 from a first to a second angular position. While in the described embodiment, the angular excursion is one-hundred and eighty degrees (180°), it should be appreciated that, when an angular change is desired, the sheet inverter 10 may accommodate any angular change within a full revolution or three-hundred and sixty degrees (360°)—albeit, the most common will generally be in multiples of ninety degrees (90°)

Figure 2:
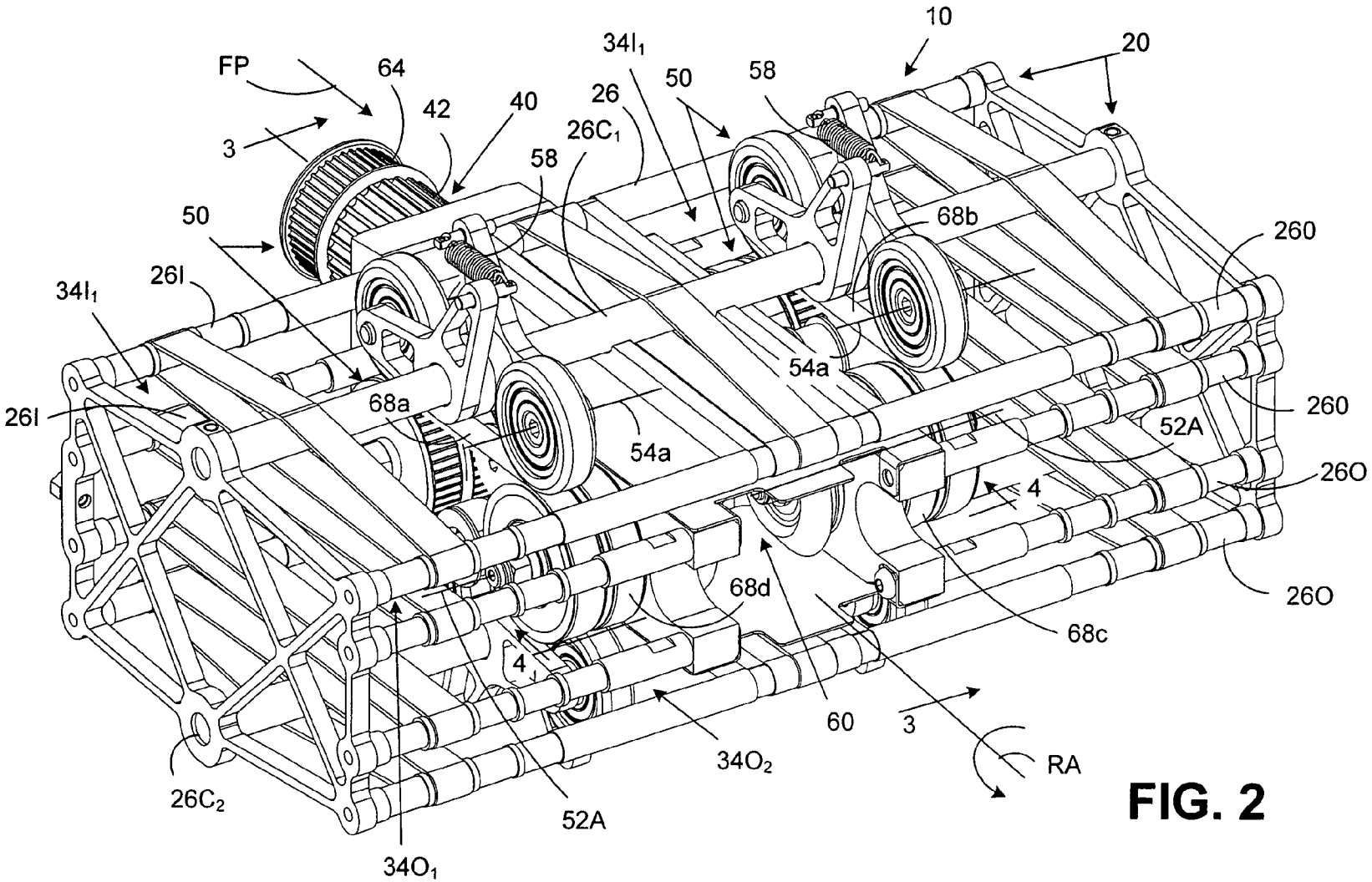
FIG. 2 is an isolated perspective of the sheet material inverter including a cage assembly, a torque drive mechanism for driving the cage assembly about a rotational axis, and a sheet conveyance mechanism for accepting and ejecting sheet material therefrom.

In response to a principle objective of the invention, the real estate occupied by the sheet inverter 10 is minimized. More specifically, the inverter 10 performs the spatial reorientation of the sheet material 16 in a minimal space envelope. Before discussing the detailed components of the sheet inverter 10, a brief description of the operational or principle elements thereof is provided. In FIG. 2, the inverter 10 includes a cage assembly 20, a torque drive mechanism 40 and a sheet conveyance mechanism 50. The cage assembly 20 serves as a structural housing for the sheet conveyance mechanism 50 and assumes the input and output positions corresponding to the desired input and output orientation of the sheet material (not shown in FIG. 2). Furthermore, the cage assembly 20 is adapted to rotate about an axis RA which is also aligned with the feed path FP traveled by the sheet material as it passes from the upstream to downstream modules 12, 14 (see FIG. 1). Moreover, the cage assembly 20 defines a central bifurcating plane 20CP which is aligned with the rotational axis RA and bisects the cage assembly 20 symmetrically about a horizontal plane. The geometric significance of these relationships will become apparent/useful when describing the various interconnecting elements and components.

The torque drive mechanism 40 is affixed to the cage assembly 20 and is operative to drive the cage assembly 20 about the rotational axis RA. While the torque drive mechanism 40 may include various drive belts and braking apparatus (not shown in FIG. 2) to accelerate, decelerate and stop the cage assembly 20, the only description required at this juncture relates to its principle function of driving torque to the cage assembly 20.

The sheet conveyance mechanism 50 mounts internally of the cage assembly 20 and is operative to convey sheet material 16 along the rotational axis RA of the cage assembly 20. In the broadest sense, the sheet conveyance mechanism 50 is adapted to: (i) receive sheet material 16 when the cage assembly 20 is in the input position (e.g., when the cage assembly 20 is disposed at an initial zero degree (0°) orientation), (ii) eject sheet material 16 when the cage assembly 20 is in an output position (e.g., when the cage assembly 20 is disposed at a final one-hundred and eighty degree (180°) orientation), and (iii) temporarily pause/retard the movement of the sheet material 16 in response to rotation of the cage assembly 20 by the torque drive mechanism 40.

Figure 3:
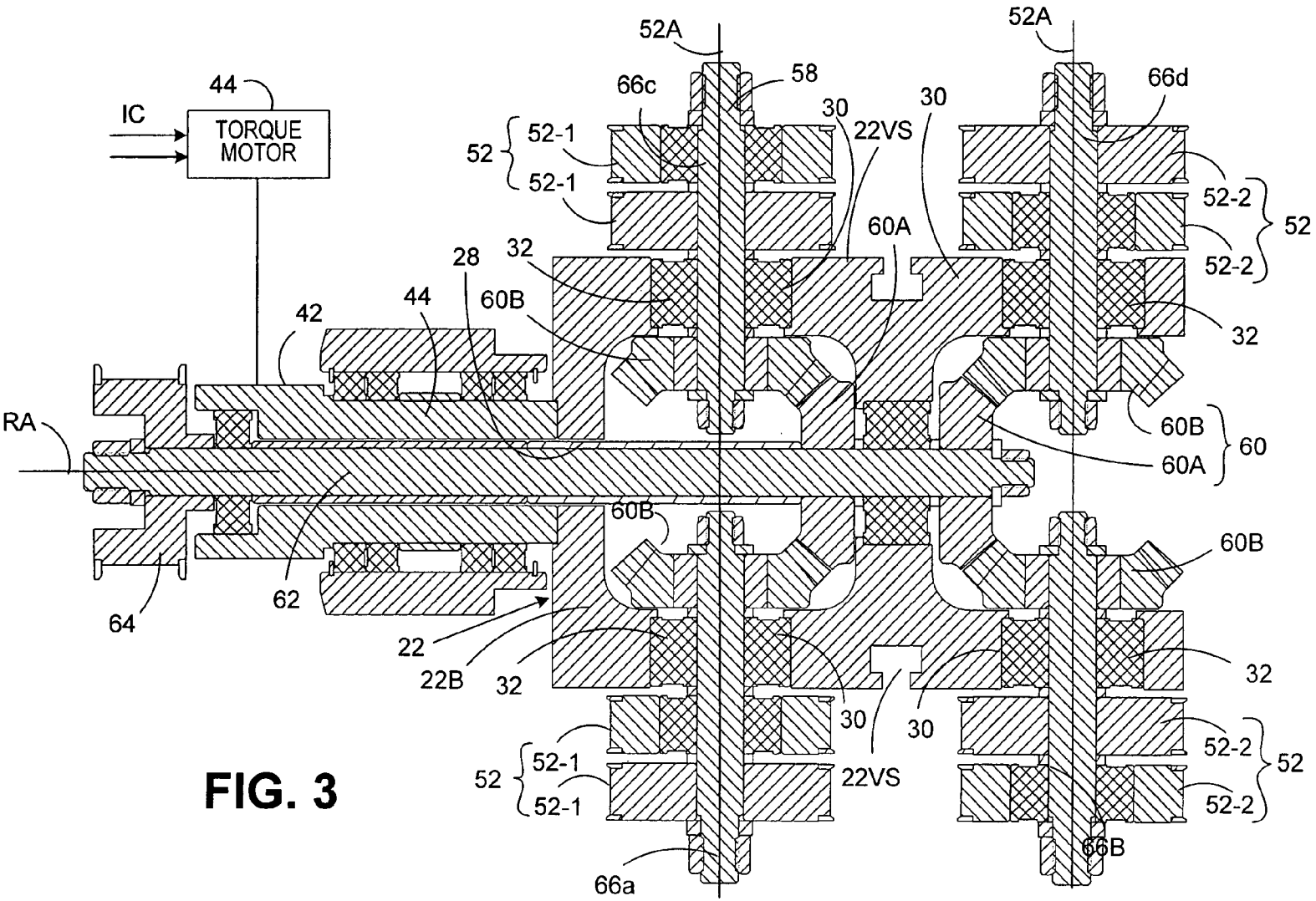
FIG. 3 is a broken-away cross-sectional view taken substantially along line 3-3 of FIG. 2 illustrating a bevel gear arrangement for driving the sheet conveyance mechanism.
Figure 4:
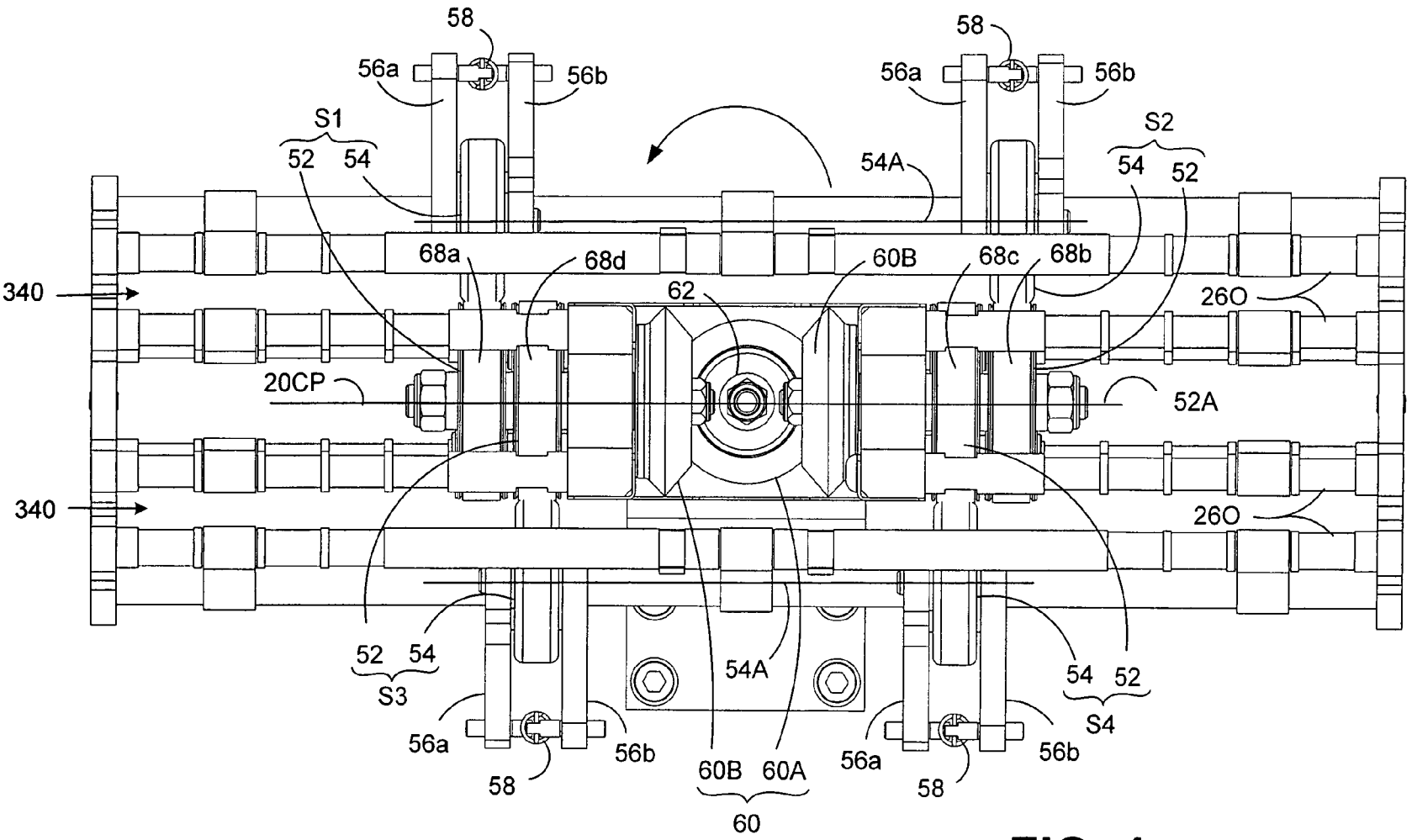
FIG. 4 is a partially broken-away cross-sectional view taken substantially along line 4-4 of FIG. 2 illustrating a front view of the bevel gear arrangement for driving the sheet conveyance mechanism.

Returning to a more detailed discussion of the inventive inverter 10, the cage assembly 20 includes a central box structure 22, structural side supports 24, and a plurality at cross-members 26 structurally interconnecting the box structure 22 with the side supports 24. The central box structure 22 includes a base 22B which is orthogonal to the rotational axis RA at the cage assembly 20, a first pair of sidewall structures 22VS substantially parallel to the structural side supports 24 and a second pair of sidewall structures 22HS substantially parallel to the central bifurcating plane 20CP. In FIGS. 3 and 4, the base 22B includes a central aperture 28 for receiving a through shaft of the sheet conveyance mechanism 50. Furthermore, the first pair of sidewall structures 22VS includes apertures 30 and bushing supports 32 for supporting a plurality of drive shafts/axles of the sheet conveyance mechanism 50. The function of the various shafts/axles will become apparent when discussing the sheet conveyance mechanism 50 in greater detail.

In addition to structurally interconnecting the central box structure 22 to the side supports 24, the cross-members 26 define inlet and outlet guides 34$I_1$, 34$I_2$, 34$O_1$, and 34$O_2$ (shown in FIGS. 2 and 4) or accepting and ejecting sheet material (not shown) there through. More specifically, pairs of cross-members 26O define a gap therebetween for guiding sheet material there through when the sheet conveyance mechanism ejects sheet material. The perspective view shown in FIG. 2 provides a full view of the outlet guides 34$O_1$, 34$O_2$, defined by and between cross-members 26O. While not shown in the perspective view, it should be appreciated that the cross-members 26I are configured in identical fashion to define first and second inlet guides 34$I_1$ and 34$I_2$.

In addition to defining inlet and outlet guides 34$I_1$, 34$I_2$, 34$O_1$, and 34$O_2$, first and second central cross-members 26$C_1$, 26$C_2$ function to provide a pivot bearing support for pairs at idler rollers of the sheet conveyance mechanism 50. In the described embodiment, a single cross-member 26$C_1$ or 26$C_2$ is employed to center and support pairs of bell cranks, though it should be appreciated that other configurations may be adapted to support the idler rollers. Once again, additional description of the idler rollers and bell cranks will be provided when discussing the sheet conveyance mechanism in further detail.

The torque drive mechanism 40 is affixed to the cage assembly 20 for driving the same about its rotational axis RA. In FIGS. 2 and 3, a splined pulley 42 is formed in combination with a drive shaft 44 (see FIG. 3) which connects to the base 22B of the cage assembly central box structure 22. A belt (not shown) defining a plurality of teeth engages the splined pulley 42 and rotates the cage assembly 20 from an input position (e.g., 0 degrees) to an output position (e.g., 180 degrees).

A torque drive motor 44 receives input command signals IC from sensors indicating when sheet material 16 has passed certain critical locations along the feed path. More specifically, photocells (not shown) may be disposed along or proximal to the terminal edges of the upstream and downstream modules 12, 14 to monitor or sense the passage of the sheet material leading and trailing edges. As the trailing edge passes a photocell, the input command signals IC may be issued to the torque drive motor 44 to initiate or terminate the rotary drive motor at a particular rotary position. A rotary encoder (not shown) may also be employed to determine the precise position of the cage assembly 20 relative to fixed reference points/locations. Furthermore, a caliper brake (not shown) may also be employed to decelerate and/or stop the cage assembly at a fixed reference position (i.e., input or output position).

In FIGS. 2-5*b*, the sheet conveyance mechanism 50 mounts to the cage assembly 20 and includes rolling elements 52, 54 for capturing sheet material therebetween and a bevel gear arrangement 60 for driving at least one of the rolling elements 54. Each of the rolling elements 52, 54 rotates about axes 52A orthogonal to the rotational axis RA of the cage assembly 20. In the described embodiment, sixteen (16) rolling elements 52, 54 define four (4) sets of control nips S1, S2, S3 and S4 wherein two (2) sets S1, S2 are disposed along an upper deck of the cage assembly 20 (to one side of the central bifurcating plane 20CP) and another two (2) sets S3, S4 are disposed along a lower deck of the cage assembly 20 (to the other side of the central bifurcating plane 20CP). As such, sheet material 16 may be accepted, parked and ejected by two sets S1, S2 or S3, S4 of control nips i.e., through the inlet and/or outlet guides 34I, 34O disposed to each side of the central plane 20CP.

Figure 5A:
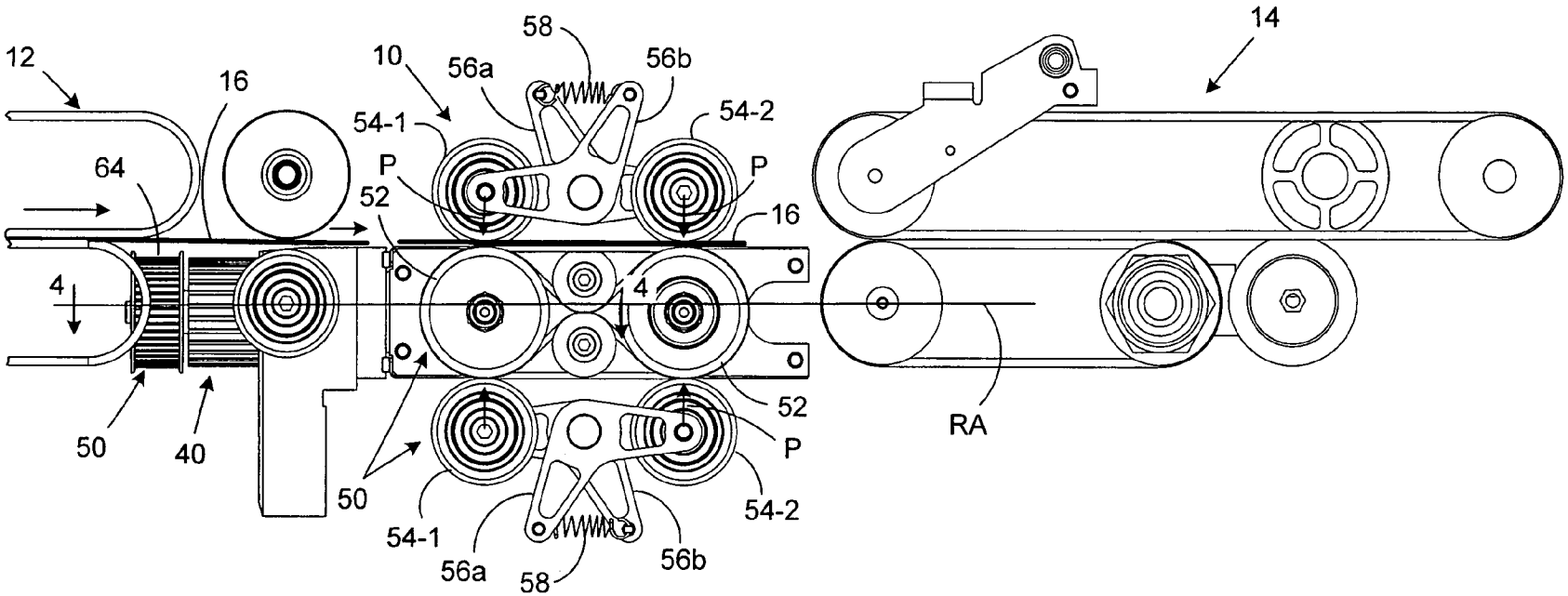
FIG. 5*a* is a cross-sectional view taken substantially along line 5*a*-5*a* of FIG. 1 illustrating the cage assembly in an input position as sheet material is loaded by the sheet conveyance mechanism from an upstream transport module.
Figure 5B:
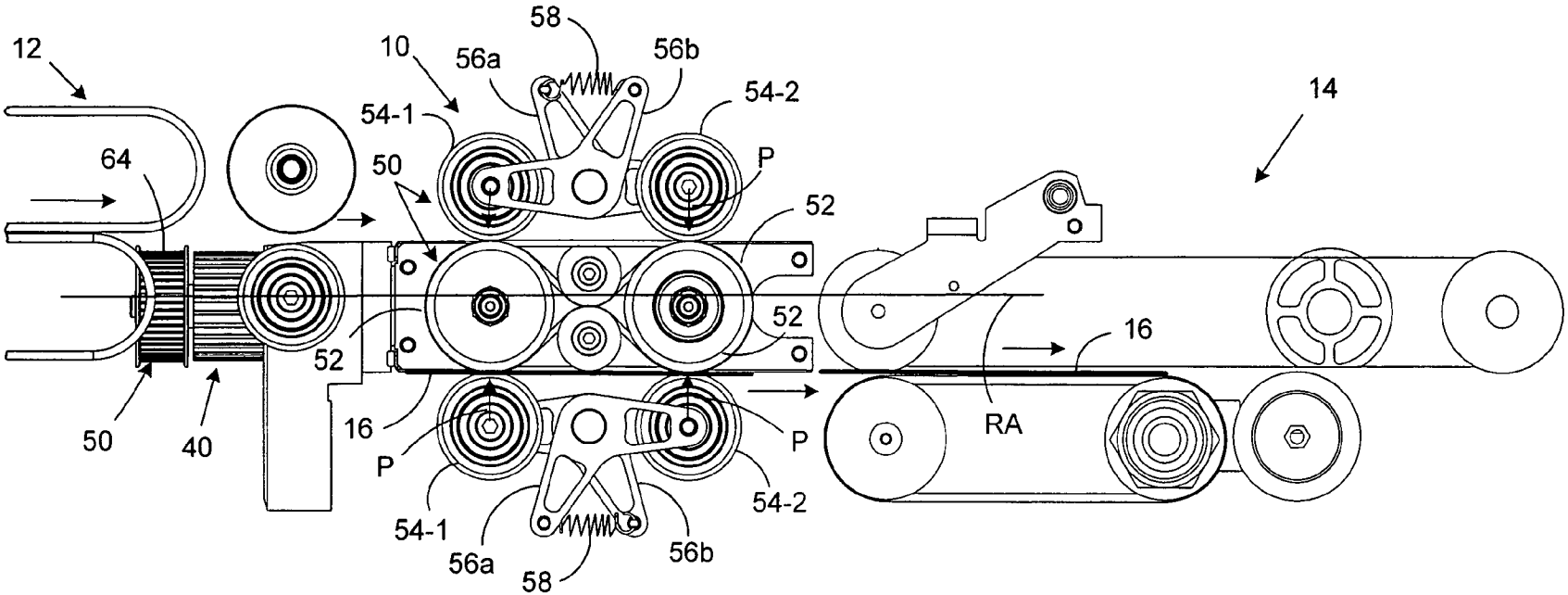
FIG. 5*b* is a cross-sectional view taken substantially along line 5*a*-5*a* of FIG. 1 illustrating the cage assembly in an output position as sheet material is ejected by the sheet conveyance mechanism to a downstream transport module.

In FIGS. 3, 5*a* and 5*b*, each set of control nips S1, S2, S3, S4 is defined by first and second drive rollers 52-1, 52-2 and first and second idler rollers 54-1, 54-2. The first and second drive rollers 52-1, 52-2 have axes 52A which are substantially coincident with the central bifurcating plane 20CP of the cage assembly 20 and are supported by/mounted to the sidewall supports 22VS of the central box structure 22. The idler rollers 54-1, 54-2 are vertically aligned with each of the drive rollers 52-1, 52-2 and are spring biased there against by a pair of scissoring bell cranks 56*a*. 56*b*. With respect to the latter, the bell cranks 56*a*, 56*b* are pivotally mounted to the central cross member 26C and biased apart by coil springs 58 which act against opposing ends of the bell cranks 56*a*, 56*b*. Consequently, rotational forces P are produced to bias the idler rollers 54-1, 54-2 against the drive rollers 52-1, 52-2.

The drive rollers 52-1, 52-2 are driven by a bevel gear arrangement 60 including pairs of first and second bevel gears 60A, 60B. In the described embodiment, a pair of first bevel gears 60A is driven by a central shaft 62 having a splined end pulley 64. The first bevel gears 60A are disposed in and driven about a plane orthogonal to the rotational axis RA of the cage assembly 20. The bevel gears 60A are oppositely disposed and engage two (2) pairs of second bevel gears 60B disposed at right angles to the first bevel gears 60A. As such, four (4) bevel gears 60B are driven by the first pair 60A in a plane parallel to the feed path of the sheet material 16. Moreover, the four (4) bevel gears 60B each impart rotary motion to drive shafts 66*a*, 66*b*, 66*c*, 66*b* which, in turn, mount to and drive each of the four (4) drive rollers 52-1, 52-2. Finally, each of the drive rollers 52-1, 52-2 drives each set of control nips S1, S2, S3 and S4 via conveyor belts 68*a*, 68*b*, 68*c*, 68*d*.

Figure 6A:
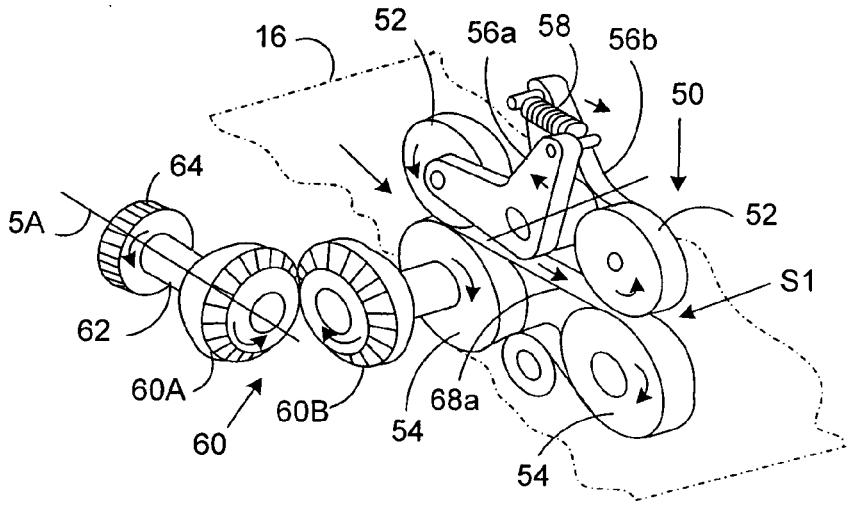
FIGS. 6*a*, 6*b* and 6*c* are simplified schematic views, shown in partial perspective, of the inverter operation as the cage assembly rotates and the sheet conveyance mechanism retards movement of the sheet material while being rotated from the input to output position.
Figure 6B:
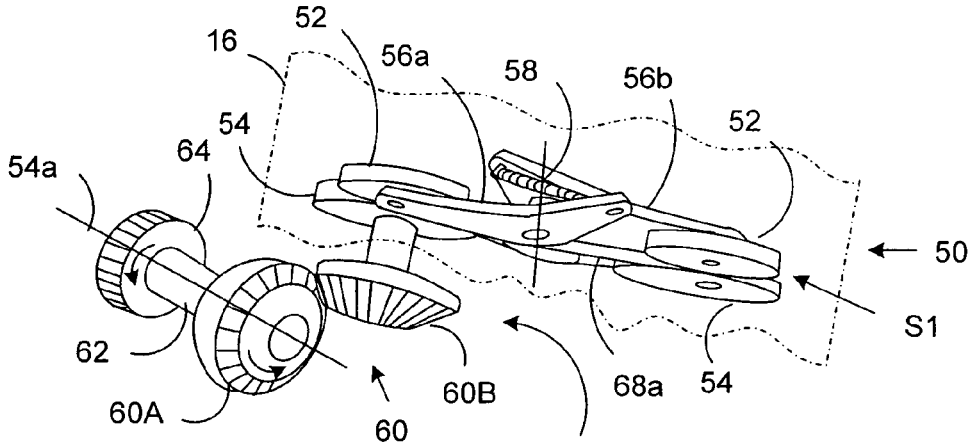
Figure 6C:
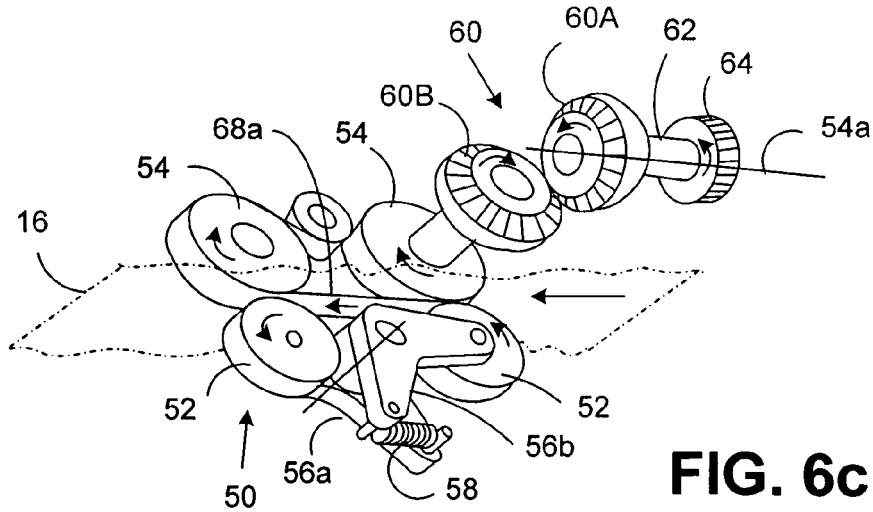

While the foregoing has described the geometry and structure of the inverter 10 according to the present invention, the following describes the function and operation of the inverter 10. More specifically, FIGS. 6*a*, 6*b*, 6*c* depict simplified perspective schematics of the invention in various operational modes. For the purposes of illustration, the cage assembly 20 has been significantly simplified to reveal the internal workings of a single one control nip S1. In FIG. 6*a*, the sheet conveyance mechanism 50 is shown accepting sheet material 16 while, in FIG. 6*c*, the mechanism 50 is shown ejecting sheet material 16 following its rotation and reorientation. The viewing angle has changed from FIG. 6*a* to FIG. 6*c* wherein FIG. 6*a* views the sheet conveyance mechanism 50 from a left overhead position and wherein FIG. 6*c* views the mechanism 50 from a right underside position. FIG. 6*b* shows the structural and functional interaction of the torque drive mechanism 40 with the sheet conveyance mechanism 50 and, more particularly, shows how the relative motion of the two mechanisms decrease, retard or pause the conveyance motion of sheet material while the cage assembly rotates from its input to output positions.

In FIG. 6*a*, the sheet conveyance mechanism 50 is in its input position and the sheet material 16 is accepted by the control nip S1 between the drive and idler rollers 54 and 52. The drive roller 54 is driven by the second bevel gear 60B which is, in turn, driven by the first bevel gear 60A. The drive shaft 62, driven by the splined pulley 64, drives the first bevel gear 60A.

In FIG. 6*b*, the entire cage assembly 20 is driven about its rotational axis RA by the torque drive mechanism (not shown). As the cage assembly 20 rotates, the second bevel gear 60B rotates or "walks" with the first bevel gear 60A. Depending upon the relative diameters of the first and second bevel gears 60A, 60B and the rotational speed of the cage assembly 20, the second bevel gear 60B can be adapted to discontinue or retard the rate that the drive roller 54 is driven. That is, by the second bevel gear 60B walking around and with the first bevel gear 60A rotation of the drive shaft (i.e., to the drive roller can be nulled. Consequently, conveyance of the sheet material 16 is retarded, paused or discontinued as the cage assembly 20 rotates about the axes RA in a direction opposing the rotational movement of the first bevel gear 60A.

In FIG. 6*c*, the cage assembly 20 has been rotated to its output position such that the sheet material 16 has been inverted. Once the cage assembly 20 is no longer being driven, i.e., has come to a rotational stop, the bevel gears 60A, 60B continue to drive the control nips 54, 52, thereby conveying or ejecting the sheet material 16 from the sheet conveyance mechanism 50 and cage assembly 20.

In summary, the sheet inversion apparatus 10 of the present invention is space efficient inasmuch as the sheet material 16 may be reoriented within a single sheet length. That is, the cage assembly 20 may be configured to rotate within a space equivalent to the length of a sheet, or slightly in excess thereof. Furthermore, the inventive inverter 10 is highly reliable inasmuch as the sheet material 16 and/or stacked collations are positively held/guided while being inverted. That is, there is never a moment in the sheet handling operation when the sheet material 16 is not under positive control i.e., between one or more control nips S1, S2, S3 or S4.

Finally, the inverter 10 may be adapted to perform job runs requiring face-up, face down or a change in angular orientation. In FIG. 5*a*, the inverter 10 is shown delivering sheet material 16 straight across the inverter from the upstream to downstream modules 12, 14 (i.e., without inversion or a change in orientation). In FIG. 5*b*, the inverter 10 is shown delivering sheet material 16 after a one-hundred and eighty (180°) inversion. Therein, the downstream module 14 is lowered to accommodate a change in vertical height produced as the sheet material 16 exists the lower deck of the cage assembly 20.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. An apparatus for inverting the spatial orientation of sheet material from a desired input orientation to a desired output orientation, comprising:

a cage assembly adapted to assume input and output positions about a rotational axis;

a torque drive mechanism operative to rotate the cage assembly about the rotational axis;

a sheet conveyance mechanism mounted to the cage assembly and operative to convey sheet material along the rotational axis of the cage assembly, the sheet conveyance mechanism, further adapted to receive sheet material when the cage assembly is in the input position, and to eject sheet material when the cage assembly is in the output position, the sheet conveyance mechanism, furthermore, operatively coupled to and cooperating with the torque drive mechanism to retard the movement of the sheet material as the cage assembly is rotated by the torque drive mechanism.

2. The apparatus according to claim 1 wherein the input and output positions invert the orientation of sheet material from a face-up to face down orientation.

3. The apparatus according to claim 1 wherein the rotational axis defines a central bifurcating plane and the cage assembly includes:

a first input guide for accepting sheet material and a first output guide for ejecting sheet material, the first input and output guides being disposed on one side of the bifurcating plane and substantially parallel thereto.

4. The apparatus according to claim 1 wherein the sheet conveyance mechanism includes:

pairs of control nips for capturing sheet material therebetween, the control nips being rotationally mounted to the cage assembly about axes orthogonal to the rotational axis of the cage assembly, and a bevel gear arrangement including a rotary motor for driving first and second intermeshing bevel gears, the first bevel gear co-axially aligned with the rotational axis of the cage assembly and driven by the rotary motor, and the second bevel gear driven by the first bevel gear for driving the control nips, wherein relative rotational motion of the bevel gear arrangement in one direction drives the control nips at a first rotational speed to transport the sheet material into and out of the cage assembly, wherein relative rotation of the bevel gear arrangement in an opposing direction drives the control nips at a second rotational speed, lower than the first rotational speed, to retard the conveyance of sheet material during rotation of the cage assembly.

5. The apparatus according to claim 4 wherein relative rotation of the bevel gears in the opposing direction is effected by rotation of the cage assembly in an opposing direction.

6. The apparatus according to claim 4 wherein the cage assembly is rotationally coupled to the torque drive mechanism by a torque drive shaft and wherein the first bevel gear of the bevel gear arrangement is driven be a shaft co-axial with the torque drive shaft.

7. The apparatus according to claim 2 wherein the cage assembly defines second input and output guides, the first input and output guides disposed on one side of the of the central bifurcating plane and the second input and output guides disposed on the other side of the central bifurcating plane;

whereby sheet material may be accepted and ejected by the cage assembly through the input and output guides on either side of the central bifurcating plane when the cage assembly is in either of its input and output positions.

8. An apparatus for inverting the spatial orientation of sheet material, comprising:

a cage assembly adapted to rotate about an axis which defines a central bifurcating plane, a torque drive mechanism operative to rotate the cage assembly about the rotational axis from an input position to an output position;

a sheet conveyance mechanism mounted to the cage assembly and comprising:

pairs of control nips disposed on opposing sides of the central bifurcating plane, each control nip including drive and idler rollers adapted to capture sheet material therebetween;

a bevel gear drive arrangement having first and second bevel gears, a first bevel gear driven by a shaft coaxially aligned with the rotational axis of the cage assembly and the second bevel gear driven by the first bevel gear about an axis orthogonal to the rotational axis, the second bevel gear rotationally coupled to and driving the drive rollers of each control nip, and a rotary drive motor for driving the bevel gear arrangement to drive each control nip;

whereby, in a first operational mode, the sheet conveyance mechanism accepts or ejects sheet material in response to rotation of the bevel gear arrangement by the rotary drive motor, and in a second operational mode, the cage assembly rotates about the rotational axis changing the relative rotation of the bevel gear arrangement such that drive of the control nips is temporarily paused to retard the conveyance of sheet material as the cage assembly rotates from the input to output positions.

9. The apparatus according to claim 8 wherein the input and output positions invert the orientation of sheet material from a face-up to face down orientation.

10. The apparatus according to claim 8 wherein the cage assembly defines:

a first input guide for accepting sheet material and a first output guide for ejecting sheet material, the first input and output guides being disposed on one side of the central bifurcating plane and substantially parallel thereto.

11. The apparatus according to claim 8 wherein the cage assembly is rotationally coupled to the torque drive mechanism by a torque drive shaft and wherein the first bevel gear of the bevel gear arrangement is driven by a shaft co-axial with the torque drive shaft.

12. The apparatus according to claim 10 wherein the cage assembly defines second input and output guides disposed on the other side of the central bifurcating plane and whereby sheet material may be accepted and ejected by the cage assembly through the input and output guides on either side of the central bifurcating plane when the cage assembly is in either of its input and output positions.

13. A method for inverting sheet material, comprising the steps of:

providing a cage assembly adapted to assume input and output positions about a rotational axis, the input and output positions corresponding to the desired input and output orientations of the sheet material;

providing a torque drive mechanism operative to rotate the cage assembly from the input to output positions, providing a sheet conveyance mechanism mounted to the cage assembly and operative to convey sheet material along the rotational axis of the cage assembly, the sheet conveyance mechanism receiving sheet material when the cage assembly is in the input position and ejecting sheet material when the cage assembly is in the output position and rotating the cage assembly by the torque drive mechanism to change the orientation of the sheet material from the input to the output orientations whereby the sheet conveyance mechanism and torque drive mechanisms are operatively coupled and cooperate to inhibit motion of the sheet material as the cage assembly rotates from the input to output positions.

14. The method according to claim 13 wherein the step of rotating the cage assembly from the input to output positions inverts the orientation of sheet material from a face-up to face down orientation.

15. The method according to claim 13 wherein the cage assembly and sheet conveyance mechanism define input and output guides to a side of a central bifurcating plane and wherein sheet material is accepted through the input guide and ejected through the output guide.

16. The method according to claim 15 wherein the input and output guides are disposed on the same side of the central bifurcating plane.

17. The method according to claim 15 wherein the input and output guides are disposed on opposite sides of the central bifurcating plane.

* * * * *